US005179805A

United States Patent [19]

Numao et al.

[11] Patent Number: 5,179,805

[45] Date of Patent: Jan. 19, 1993

[54] SANDING METHOD AND APPARATUS

[75] Inventors: Suteyoshi Numao, Kanuma; Makoto Miyajima, Hino, both of Japan

[73] Assignees: Murunaka & Co., Ltd.; Marunaka Kakoki Co., Ltd.; Marunaka Tsusho Co., Ltd., all of Shizuoka, Japan

[21] Appl. No.: 292,392

[22] Filed: Dec. 30, 1988

[30] Foreign Application Priority Data

| | | | |
|---|---|---|---|
| Sep. 19, 1988 | [JP] | Japan | 63-234242 |
| Sep. 19, 1988 | [JP] | Japan | 63-234243 |
| Nov. 14, 1988 | [JP] | Japan | 63-148673[U] |
| Nov. 14, 1988 | [JP] | Japan | 63-148674[U] |

[51] Int. Cl.[5] ..... B24B 21/00

[52] U.S. Cl. ..... 51/149; 51/150; 51/61; 51/62

[58] Field of Search ..... 51/61, 62, 59 R, 135 R, 51/135 BT, 136, 137, 138, 139, 141, 142, 148, 150, 151, 154, 262 A, 266, 328, 357, 399

[56] References Cited

U.S. PATENT DOCUMENTS

| | | | |
|---|---|---|---|
| 1,286,697 | 12/1918 | Manofsky . | |
| 2,258,733 | 10/1941 | Brackett | 51/62 |
| 2,507,372 | 5/1950 | Emmons | 51/135 BT |
| 2,594,647 | 4/1952 | Hendrickson | 51/135 R |
| 2,838,890 | 6/1958 | McIntyre . | |
| 2,984,052 | 5/1961 | Mueller, Jr. . | |
| 3,029,566 | 4/1962 | Simendinger . | |
| 3,099,904 | 8/1963 | Bell | 51/266 X |
| 3,167,889 | 2/1965 | Jacobi | 51/141 |
| 3,416,261 | 12/1968 | Sherman et al. . | |
| 3,510,987 | 5/1970 | Ernst | 51/141 X |
| 3,541,736 | 11/1970 | Takekawa | 51/141 |
| 3,608,245 | 9/1971 | Fair et al. | 51/135 BT |
| 3,715,839 | 2/1973 | Heesemann | 51/62 X |
| 4,628,641 | 12/1986 | Lazzari | 51/142 X |
| 4,651,474 | 3/1987 | David . | |
| 4,742,650 | 5/1988 | Sauder, Jr. et al. | 51/142 X |

FOREIGN PATENT DOCUMENTS

| | | |
|---|---|---|
| 1652110 | 4/1967 | Fed. Rep. of Germany . |
| 1652073 | 10/1970 | Fed. Rep. of Germany . |
| 3104431 | 10/1982 | Fed. Rep. of Germany . |
| 3642086 | 6/1988 | Fed. Rep. of Germany . |
| 1054799 | 2/1954 | France . |
| 1143885 | 10/1957 | France . |
| 1519065 | 2/1968 | France . |
| 2003866 | 11/1969 | France . |
| 59-69254 | 4/1984 | Japan . |
| 8104694 | 10/1981 | Netherlands . |
| 681996 | 6/1949 | United Kingdom . |
| 1044039 | 10/1963 | United Kingdom . |

OTHER PUBLICATIONS

Wirtschaft und Betrieb, 4540 Holz als Roh- und Werkstoff 47 (1989) Mar., No. 3, Berlin DE.

Lärmminderungmassnahmen beim Bandschleifen an Kontaktscheiben, 215 V.D.I. Zeitschrift vol. 124 (1982) Jun., No. 11, Düsseldorf, Germany.

*Primary Examiner*—M. Rachuba

[57] ABSTRACT

Two juxtaposed sanding belts are pressed against a surface of a wood workpiece which is being fed on a table in a direction. The sanding belts are simultaneously reciprocally moved in mutually opposite directions along the workpiece feeding direction, thereby sanding the workpiece surface. Each of the sanding belts is oriented in a direction transverse to the feeding direction. The sanding belts are pressed against the workpiece surface by respective pads each having a pressing surface complementary in shape to the workpiece surface being sanded.

35 Claims, 11 Drawing Sheets

SANDING METHOD AND APPARATUS

BACKGROUND OF THE INVENTION

The present invention relates to a sanding method and apparatus, and more particularly to a method of and an apparatus for efficiently and highly accurately sanding an unpainted or painted surface of a wood component of wood furniture and fittings.

Many pieces of wood furniture and fittings, such as doors and decorative panels, generally include frames having carved or uneven surfaces with elongated straight convexes and concaves. After the surface of a wood frame has been carved by a machine, the carved surface is sanded and painted, and then the painted film is sanded to finish the painted surface smoothly.

FIGS. 1 and 2 of the accompanying drawings shows a conventional apparatus for sanding a carved wood surface and a painted wood surface. As shown in FIG. 1, a workpiece (frame) 4 is placed on a horizontal table 2, and feed rollers 6*a*, 6*b* are rotated counterclockwise (FIG. 1) in the direction of the arrows to move the workpiece 4 to the left in the direction of the arrow.

An endless sanding belt 10 trained around rollers 8*a*, 8*b* is disposed above the table 2 and extends in the direction in which the workpiece 4 is fed. The rollers 8*a*, 8*b* are rotated counterclockwise (FIG. 1) to move the sanding belt 10 in the direction opposite to the direction of travel of the workpiece 4, and at the same time the portion of the sanding belt 10 between the rollers 8*a*, 8*b* is pressed down against the workpiece 4 by a pad 12 to sand the workpiece 4. The sanded surface of the workpiece 4 is carved or has an elongate straight convex 4*a* and an adjacent elongate straight concave 4*b*, each having an arcuate cross-sectional shape. The pad 12 has a pressing surface 12*a* (FIG. 2) which also has a concave and a convex that are complementary to the convex 4*a* and the concave 4*b*, respectively, of the workpiece 4.

With the conventional sanding apparatus, the width of the sanding belt 10 has to be be larger than the width of the pad 12 so that the sanding belt 10 will not disengage from the pad 12 while the workpiece 4 is being sanded. Therefore, the sand belt 10 has opposite marginal edge portions 10*a*, 10*b* of a relatively large width which are not used in sanding the workpiece 4, and hence is quite uneconomical.

Since the pad 12 is pressed against the inner surface of the sanding belt 10 which is being moved by the rotating rollers 8*a*, 8*b*, the inner surface of the sanding belt 10 and the pressing surface 12*a* of the pad 12 are quickly worn to a large extent. To prevent the pad 12 from being worn out soon, it is necessary to apply an abrasion-resistant resin or an abrasion-resistant material such as graphite or the like to the pressing surface 12*a* of the pad 12. Accordingly, the cost of the pad 12 is high.

Another problem is that because the moving sanding belt 10 is pressed against the workpiece 4 by the pad 12, the workpiece 4 is subjected to large resistive forces applied in the direction opposite to the direction of travel of the workpiece 4. Therefore, a highly powerful actuator mechanism is needed to feed the workpiece 4 in the direction of the arrow on the table 2. Because of the powerful actuator mechanism thus required, the apparatus is also uneconomical and large in size.

Also, in view of the large load forces required to move the workpiece through the sanding apparatus, a large number of rollers, including upper rollers 6*a* and lower rollers 6*b* are required. The large number of rollers required, and particularly the upper rollers 6*a*, make it difficult to provide a sanding belt that can highly, accurately access inner areas of the workpiece. Thus, for example as shown in FIG. 2, an inside surface contour 4*c* of the workpiece cannot be accurately and evenly sanded.

During sanding operation, the sanding belt 10 is greatly tensioned since the pad 12 is pressed against the inner surface of the moving sanding belt 10 to sand the workpiece 4. While the convex surface 4*a* of the workpiece 4 can be sanded well, the steep surfaces of the concave surface 4*b* may not sufficiently be sanded. As a result, the curved surface of the workpiece 4 cannot uniformly be sanded in its entirety. If the concave surface 4*b* is to be sanded to the extent which is necessary, then the convex surface 4*a* will be sanded excessively. When the painted surface is sanded, the paint film may locally be removed. Also, it may not even be possible to access and accurately sand inside surface contours 4*c* in such a curved workpiece.

The pressing surface 12*a* of the pad 12 is shaped complementarily to the curved surface of the workpiece 4 as described above. However, the configuration of such curved surface tends to vary from workpiece to workpiece, and it would be impossible to keep the sanding belt 10 in neat and reliable contact with the carved surfaces of different workpieces 4 by means of the pressing surface 12*a* of the pad 12. Use of the pad 12 for sanding the carved surfaces of different workpieces 4 would therefore result in sanding failures.

When the workpiece 4 is sanded by the sanding belt 10, the abrasive of the sanding belt 10 may be loaded and become useless within a relatively short period of time dependent on the sanding speed and the pressure with which the sand belt 10 is pressed against the workpiece 4. When the sanding belt 10 is applied to sand the workpiece 4, the sanding belt 10 is heated to accelerate the deterioration and loading thereof. The heating of the sanding belt 10 is also responsible for thermally modifying the painted surface of the workpiece 4 which is being sanded.

Another known sanding apparatus includes a sandpaper applied to the entire pressing surface of a pad, which is reciprocally moved relatively to a workpiece while the sandpaper is pressed against the surface of the workpiece being sanded.

Since the sanding apparatus causes violent vibration when the pad is reciprocally moved, the sanding apparatus itself needs to have a special vibroisolating structure. The vibration of the sanding apparatus and the degree of resistance to the movement of the pad widely differ between the direction of travel of the workpiece and the opposite direction, with the consequence that the surface of the workpiece cannot be sanded uniformly and smoothly. Since the sandpaper is fixed to the pad itself, the pad must be replaced relatively frequently, and the replacement procedure is tedious and time-consuming. The cost of the sanding apparatus is high because it requires a plurality of replacement pads.

SUMMARY OF THE INVENTION

It is a primary object of the present invention to provide a method of and an apparatus for sanding workpieces efficiently with a sanding belt while reducing resistance to the movement of the workpieces and vibrations applied thereto to the greatest extent possible, by providing a sanding apparatus with two sanding mechanisms moving in mutually opposite directions at all times so as to effectively equalize the forces exerted to the workpiece by the sanding mechanisms and to minimize load requirements for moving the workpiece through the sanding apparatus. At the same time, since load requirements are reduced, several of the rollers ordinarily required to move the workpiece may be eliminated. Therefore, the sanding mechanism can occupy less space and can reach even inner areas, for example inside surface contours, of the workpiece most accurately. Thus the sanding belt can be held reliably in intimate contact with curved or uneven surfaces of the workpiece even if the workpiece surfaces have different shapes, so that the workpieces can be sanded highly accurately.

Another object of the present invention is to provide a method of sanding a surface of a workpiece, comprising the steps of: providing a plurality of sanding members in juxtaposed relation; pressing said sanding members against the surface of the workpiece; and reciprocally moving said sanding members simultaneously in mutually different directions.

Still another object of the present invention is to provide a sanding method comprising feeding said workpiece in a feeding direction; providing said sanding members in juxtaposed relation substantially along said feeding direction; and reciprocally moving said sanding members simultaneously in mutually different directions along said feeding direction.

Yet another object of the present invention is to provide a sanding method wherein said sanding members substantially comprise web-like sanding members, comprising the step: intermittently feeding said web-like sanding members by successive lengths in a direction transverse to said mutually different directions to sand said surface of the workpiece with successively new sanding areas on the web-like sanding member.

It is also an object of the present invention to provide an apparatus for sanding a surface of a workpiece, comprising: table means for feeding said workpiece thereon in at least one direction; and a sanding mechanism for pressing a sanding member against the surface of said workpiece to sand said surface, said sanding member comprising a substantially web-like sanding member oriented in a direction transverse to said one direction.

Still another object of the present invention is to provide a sanding apparatus wherein said sanding mechanism includes a body and feed means mounted on said body for intermittently feeding said web-like sanding member by successive lengths toward said surface of the workpiece.

Still another object of the present invention is to provide a sanding apparatus wherein said web-like sanding member comprises an endless sanding belt, said feed means comprising a driver roller around which said sanding belt is trained, ratchet means associated with said driver roller, and an actuator for rotating said driver roller in angular increments only in one direction through said ratchet means.

Still another object of the present invention is to provide a sanding apparatus wherein said actuator comprises a cylinder having a piston rod, said feed means further comprising a chain having one end connected to said piston rod, a chain wheel associated with said ratchet means with said chain trained around said chain wheel, a spring connected to the other end of said chain, whereby said cylinder is actuated to pull said chain longitudinally to cause said chain wheel to rotate said driver roller in a first direction, and said cylinder is inactivated to allow said chain wheel only to rotate in a second direction opposite to said first direction under the bias of said spring.

Yet another object of the present invention is to provide a sanding apparatus wherein said cylinder comprises an air cylinder, further including a nozzle connected to said air cylinder for ejecting air discharged from said air cylinder against said sanding belt to clean the sanding belt.

Still another object of the present invention is to provide a sanding apparatus wherein said feed means further comprises an adjustment screw and a resilient member which engage opposite sides of a rotatable shaft extending axially from said driver roller, whereby said driver roller can be tilted by turning said adjustment screw.

Yet another object of the present invention is to provide a sanding apparatus further including a block which is movable at least vertically, and a bracket mounted on said block, said body being tiltably supported on said bracket.

Still another object of the present invention is to provide a sanding apparatus wherein said sanding mechanism further includes at least one swing arm having one end attached to said body and resiliently biased by a resilient member, and a roller supported on the other end of said swing arm, said sanding belt being also trained around said roller.

Still another object of the present invention is to provide a sanding apparatus wherein said sanding mechanism includes a pair of swing arms having ends attached respectively to opposite sides of said body, a pair of rollers supported on the other ends of said swing arms, respectively, said sanding belt being also trained around said rollers, and a pad movably mounted on said body between said rollers, the arrangement being such that said sanding belt can be pressed against the surface of said workpiece by displacing said pad toward said workpiece.

Yet another object of the present invention is to provide a sanding apparatus wherein said sanding mechanism also includes a cylinder and a resilient member for causing said pad to resiliently press said sanding belt against said surface of the workpiece.

Yet another object of the present invention is to provide a sanding apparatus wherein said table means comprises a first table extending in said one direction, and an auxiliary table disposed alongside of said first table and positionally adjustable in a direction normal to said one direction.

Yet still another object of the present invention is to provide a sanding apparatus wherein said table means further comprises a second table vertically movably disposed below said first table.

Yet still another object of the present invention is to provide a sanding apparatus further comprising a control box for controlling operation of said sanding mechanism, said control box being positionally adjustable in a direction normal to said one direction.

Yet another object of the present invention is to provide a sanding apparatus further including a suction port for drawing sanded particles, said suction port being disposed near a region where said surface of the workpiece and said sanding member engage each other.

It is a further object of the present invention to provide an apparatus for sanding a surface of a workpiece, comprising: table means for feeding said workpiece thereon in at least one direction; and a pair of sanding mechanisms for pressing respective sanding members against the surface of said workpiece to sand said surface, said sanding mechanisms including respective pads for pressing said sanding members against the surface of said workpiece, said sanding mechanisms being reciprocally movable in mutually different directions along said one direction.

A still further object of the present invention is to provide a sanding apparatus wherein each of said pads having a pressing surface complementary in shape to the shape of said surface of the workpiece, each of said sanding mechanisms includes a cylinder and a resilient member for causing said pad to resiliently press said sanding member against said surface of the workpiece.

A still further object of the present invention is to provide a sanding apparatus wherein each of said sanding members comprises an endless sanding belt.

A still further object of the present invention is to provide a sanding apparatus further including a block which is movable at least vertically, said first and second sanding mechanisms being movably mounted on said block, and displacing means for reciprocally moving said first and second sanding mechanisms toward and away from each other.

A yet further object of the present invention is to provide a sanding apparatus wherein said displacing means comprises a rotative drive source, and a pair of crank means operatively coupled to said rotative drive source, said crank means being operatively connected to said first and second sanding mechanisms, whereby said first and second sanding mechanisms can be moved toward and away from each other by said rotative drive source through said respective crank means.

A yet further object of the present invention is to provide a sanding apparatus wherein said displacing means comprises a pair of linear actuators for displacing said first and second sanding mechanisms, respectively, toward and away from each other.

A still further object of the present invention is to provide a sanding apparatus further including guide means mounted on said block, said first and second sanding mechanisms including respective sliders mounted on said guide means, respective brackets coupled to said sliders, respectively, and respective bodies tiltably supported on said brackets, respectively.

A yet still further object of the present invention is to provide a sanding apparatus wherein each of said sanding mechanisms further includes at least one swing arm having one end attached to said body and resiliently biased by a resilient member, and a roller supported on the other end of said swing arm, each of said sanding members comprising an endless sanding belt trained around said roller.

A still further object of the present invention is to provide a sanding apparatus wherein each of said sanding mechanisms includes a pair of swing arms having ends attached respectively to opposite sides of said body, and a pair of rollers supported on the other ends of said swing arms, respectively, said sanding belt being also trained around said rollers, each of said pads being movably mounted on said body between said rollers, the arrangement being such that said sanding belt can be pressed against the surface of said workpiece by displacing said pad toward said workpiece.

Another object of the present invention is to provide a sanding apparatus wherein said table means comprises a first table extending in said one direction, and an auxiliary table disposed alongside of said first table and positionally adjustable in a direction normal to said one direction.

Still another object of the present invention is to provide a sanding apparatus wherein said table means further comprises a second table vertically movably disposed below said first table.

Still another object of the present invention is to provide a sanding apparatus further comprising a control box for controlling operation of said sanding mechanisms, said control box being positionally adjustable in a direction normal to said one direction.

Still another object of the present invention is to provide a sanding apparatus further including a suction port for drawing sanded particles, said suction port being disposed near a region where said surface of the workpiece and said sanding members engage each other.

It is also an object of the present invention to provide an apparatus for sanding a surface of a workpiece, comprising: table means for feeding said workpiece thereon in at least one direction; and a sanding mechanism for pressing a sanding member against the surface of said workpiece to sand said surface, said sanding mechanism including a pad for pressing said sanding member against the surface of said workpiece, said pad having a pressing surface complementary in shape to said surface of the workpiece and having at least one cut defined therein and dividing said pad into a plurality of pressing regions.

Yet another object of the present invention is to provide a sanding apparatus wherein said pad has a plurality of cuts defined in said pressing surface and extending transversely to said one direction.

Yet still another object of the present invention is to provide a sanding apparatus wherein said pad has a recess defined in a corner thereof and complementary in shape to a surface at a corner of said workpiece.

A further object of the present invention is to provide a sanding apparatus wherein said sanding mechanism has an actuator and an attachment base movable by said actuator, said pad being attached to said attachment base, said attachment base having a pair of guides projecting downwardly from opposite sides thereof across said one direction, said pad being held between said guides.

A still further object of the present invention is to provide an apparatus for sanding a surface of a workpiece, comprising: table means for feeding said workpiece thereon in at least one direction; and a sanding mechanism for pressing a sanding member against the surface of said workpiece to sand said surface, said sanding member comprising a substantially web-like sanding member having spaces therein for preventing the sanding member from being loaded and for radiating frictional heat produced when the surface of the workpiece is sanded by said sanding member.

A yet further object of the present invention is to provide a sanding apparatus wherein said sanding member has a plurality of holes defined therein as said spaces.

A yet further object of the present invention is to provide a sanding apparatus wherein said sanding member is of a mesh structure having said spaces.

A yet still further object of the present invention is to provide a sanding apparatus wherein said web-like sanding member comprises an endless sanding belt.

The above and other objects, features and advantages of the present invention will become more apparent from the following description when taken in conjunction with the accompanying drawings in which preferred embodiments of the present invention are shown by way of illustrative example.

DETAILED DESCRIPTION OF THE PREFERRED EMBODIMENTS

Figure 1:
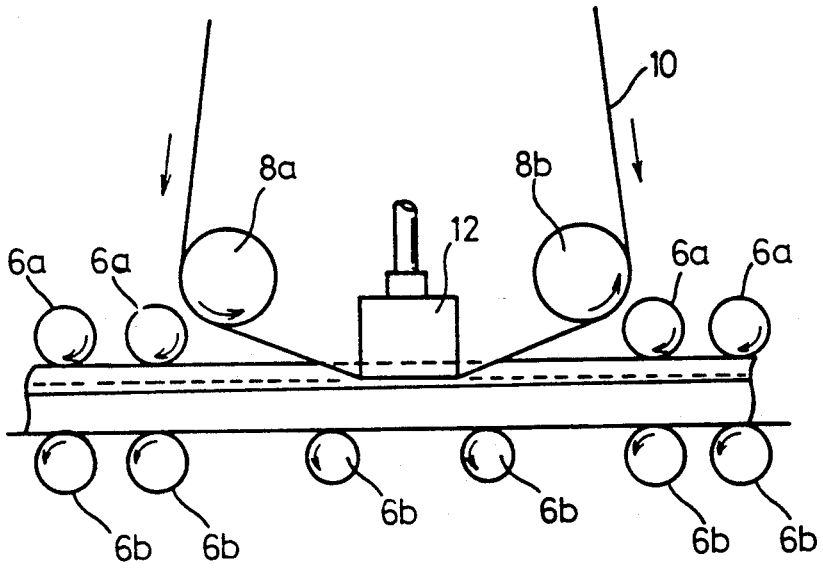
FIGS. 1 and 2 ar front elevational and vertical cross-sectional views, respectively, showing the manner in which a workpiece is sanded by a conventional sanding apparatus.
Figure 2:
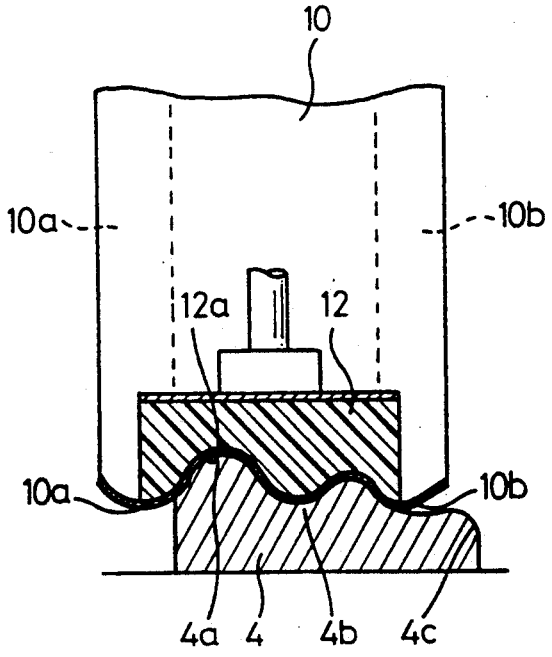
Figure 3:
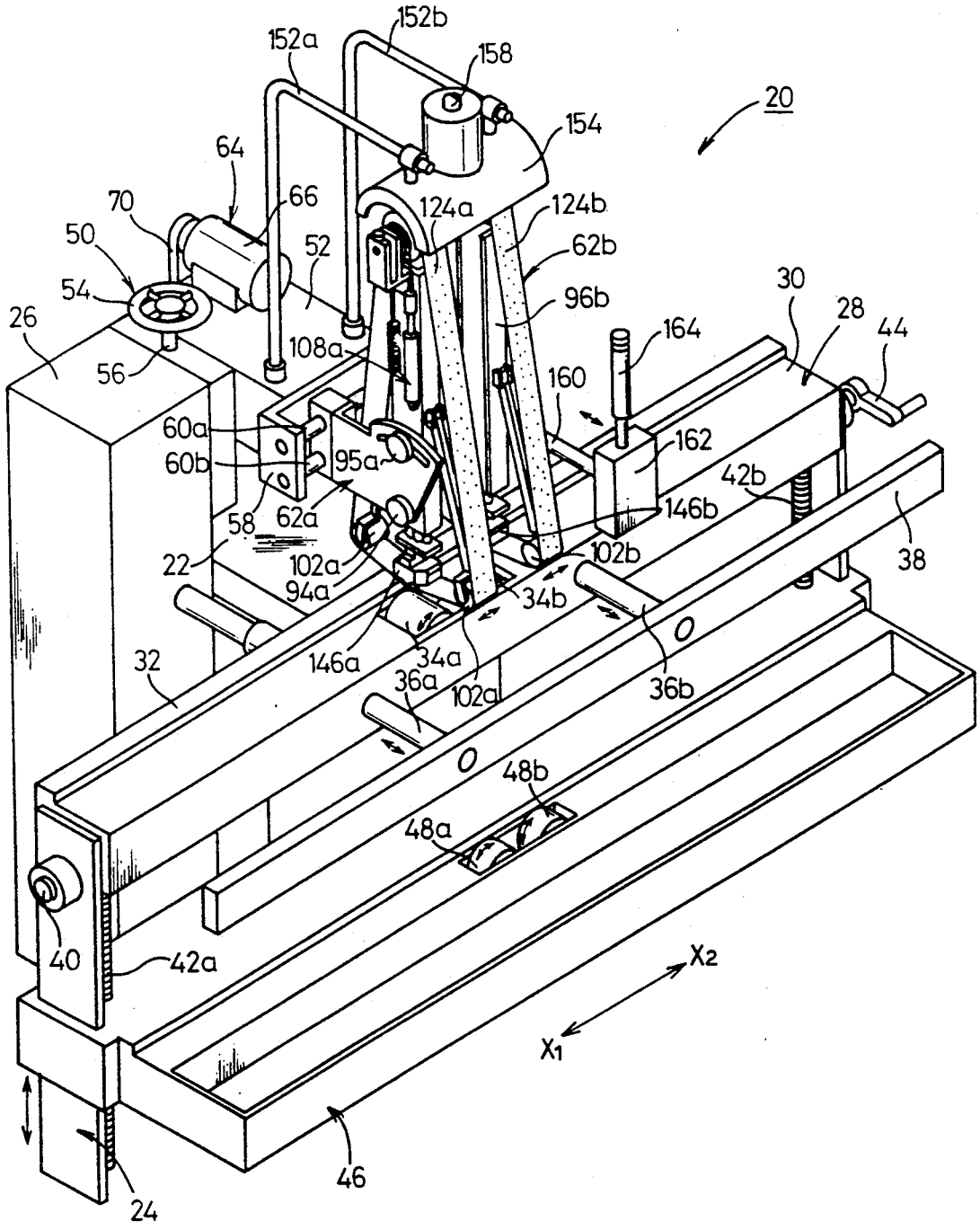
FIG. 3 is a perspective view of a sanding apparatus for carrying out a sanding method according to the present invention.
Figure 4:
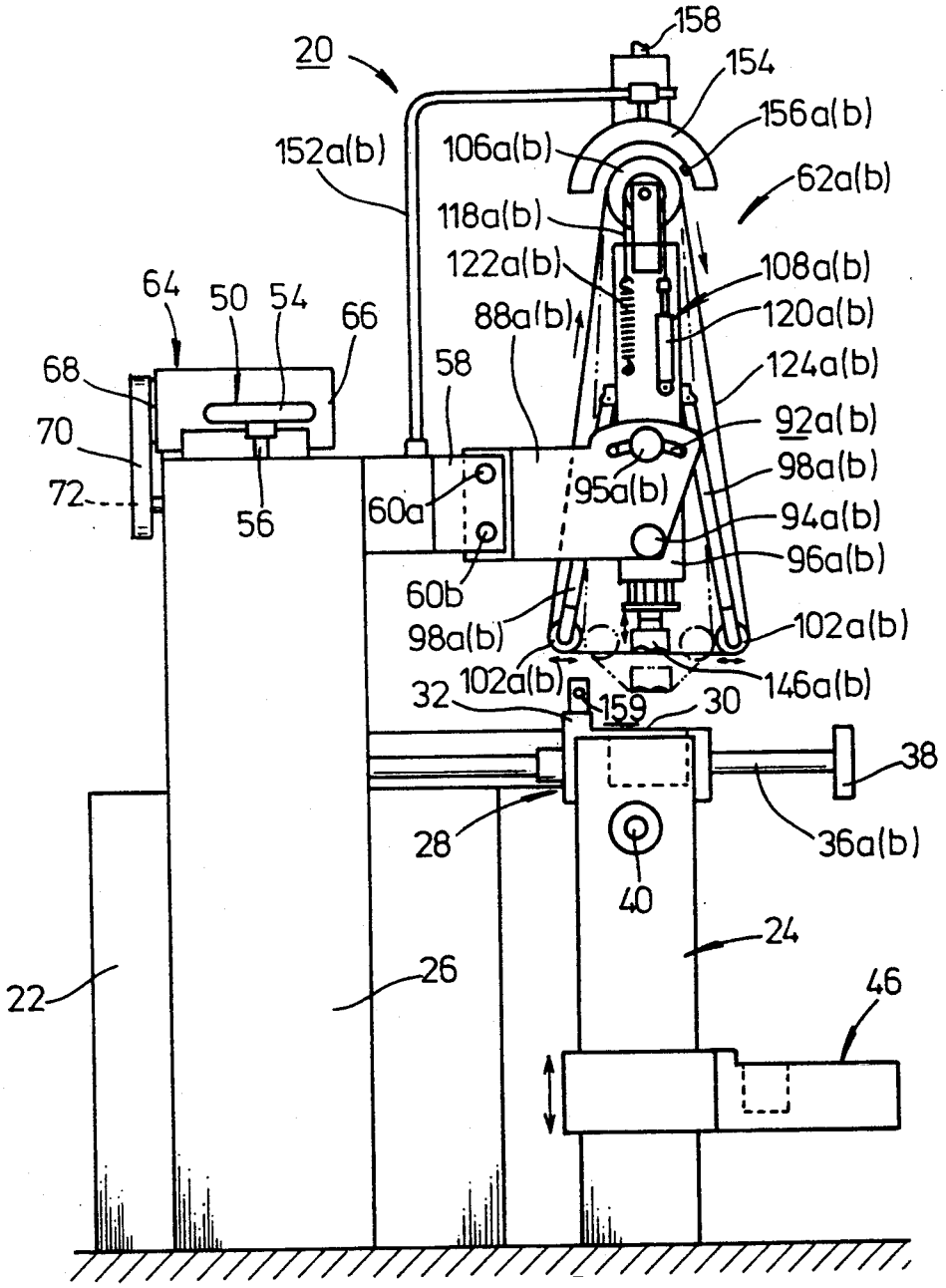
FIG. 4 is a side elevational view of the sanding apparatus shown in FIG. 3.

FIGS. 3 and 4 illustrate a sanding apparatus, generally designated by the reference numeral 20, according to the present invention. The sanding apparatus 20 includes a base 22 installed on a floor, a frame 24 disposed on the floor in front of the base 22, and an upstanding casing 26 disposed on the floor laterally of the base 22. A relatively long first table 28 is horizontally installed on the upper end of the frame 24 and includes an upper smooth support surface 30 and an elongate guide wall 32 positioned transversely on one side of the first table and projecting upwardly from the support surface 30, the guide wall 32 extending in the longitudinal direction of the first table 28. A pair of feed rollers 34*a*, 34*b* is supported substantially centrally in the first table 28, the feed rollers 34*a*, 34*b* being rotatable selectively in opposite directions by a rotative drive source (not shown). The feed rollers 34*a*, 34*b* have upper ends slightly projecting upwardly from the support surface 30. Two guide bars 36*a*, 36*b* extend axially slidably through the first table 28 in the transverse direction thereof. An auxiliary table 38 is attached to the ends of the guide bars 36*a*, 36*b*. The auxiliary table 38 has an upper surface at the same level as the support surface 30 of the first table 28. The auxiliary table 38 is transversely movable with respect to the first table 28 to adjust the distance between the tables 28, 38 dependent on the dimensions of a workpiece to be sanded by the sanding apparatus 20.

A first screw shaft 40 is rotatably supported on the frame 24 below the first table 28 and held in mesh with second screw shafts 42*a*, 42*b* which extend vertically at the opposite ends of the frame 24 and are rotatably supported thereby. A handle 44 is mounted on one end of the first screw shaft 40. A second table 46 is supported on the second screw shafts 42*a*, 42*b*. The second table 46 has feed rollers 48*a*, 48*b* that are rotatable selectively in opposite directions by a rotative drive source (not shown).

A block 52 is mounted on an upper portion of the casing 26 by means of a lifting and lowering means 50. The lifting and lowering means 50 has a rotatable shaft 56 connected to a handle 54 and coupled to a ball screw (not shown) or the like such that the block 52 can be lifted and lowered by rotating the shaft 56 with the handle 54. The block 52 is also movable back and forth with respect to the lifting and lowering means 50 in directions across the first table 28 by means of an actuator (not shown).

A guide frame 58 is attached to the end surface of the block 52 which projects toward the frame 24. A pair of parallel, vertically spaced guide bars 60*a*, 60*b* is mounted on the guide frame 58. First and second sanding mechanisms 62*a*, 62*b* are mounted on the guide bars 60*a*, 60*b* and reciprocally movable in mutually opposite directions by a displacing means 64.

Figure 5:
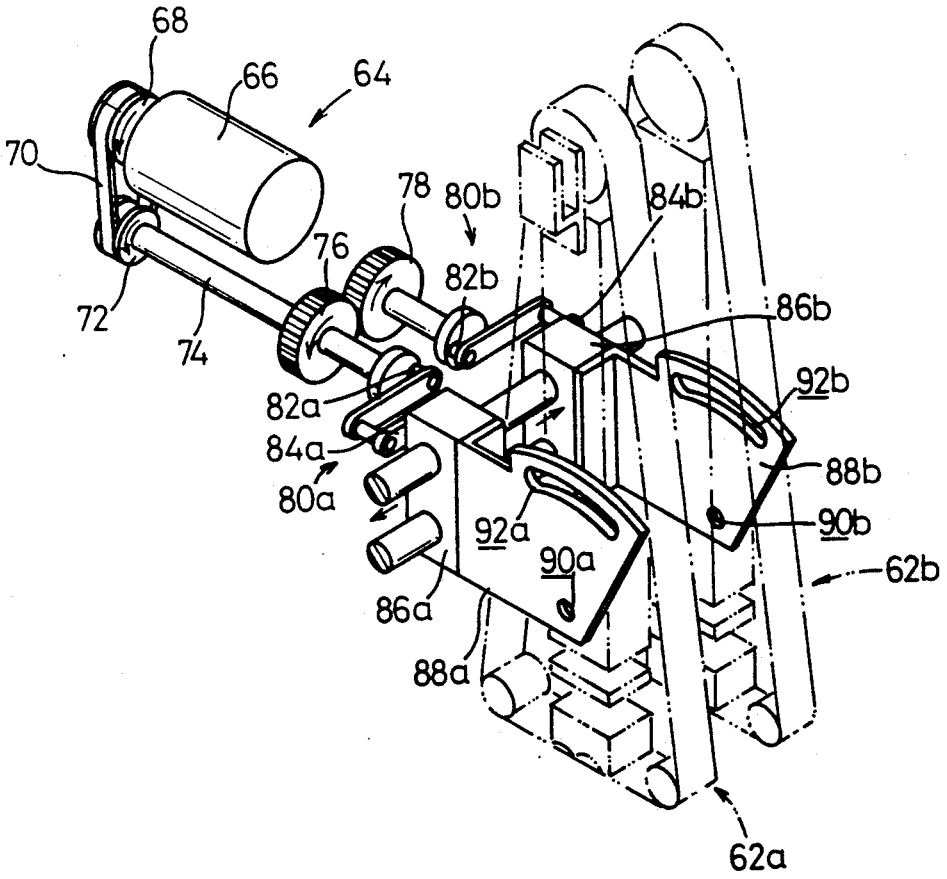
FIG. 5 is a perspective view of a displacing means of the sanding apparatus of the invention.

As illustrated in FIG. 5, the displaying means 64 has a rotative drive source 66 fixedly mounted on the block 52 and having a rotatable shaft (not shown) on which a first pulley 68 is mounted. The first pulley 68 is operatively connected by a belt 70 to a second pulley 72 mounted on a rotatable shaft 74. The shaft 74 extends through the block 52 toward the guide frame 58 and supports thereon a first gear 76 held in mesh with a second gear 78. Pins 82*a*, 82*b* of crank means 80*a*, 80*b* are eccentrically connected respectively to the first and second gears 76, 78. The crank means 80*a*, 80*b* also include respective crank members 84*a*, 84*b* which are coupled respectively to sliders 86*a*, 86*b* of the first and second sanding mechanisms 62*a*, 62*b*. The sliders 86*a*, 86*b* are slidably fitted over the guide bars 60*a*, 60*b* so as to be supported on the guide frame 58.

The first and second sanding mechanisms 62*a*, 62*b* are structurally and functionally identical to each other. Therefore, only the first sanding mechanism 62*a* will be described in detail below, with the components of the second sanding mechanism 62*b* being denoted by identical reference numerals with a suffix b.

The first sanding mechanism 62*a* includes a plate-like bracket 88*a* secured to the slider 66*a* and having a hole 90*a* defined in a lower portion thereof and an arcuate guide groove 92*a* defined in an upper portion thereof and extending about the hole 90*a*. As shown in FIGS. 3 and 4, two threaded knobs 94*a*, 95*a* are inserted through the hole 90*a* and the guide groove 92*a*, respectively, and have tip ends threaded into respective threaded holes (not shown) defined in a body 96*a*. Therefore, the body 96*a* is tiltably supported on the bracket 88*a* so that the body 96*a* can be tilted through a predetermined angle with respect to the bracket 88*a*. The body 96*a* comprises a vertically extending casing on which substantially vertically central positions on opposite sides of the body 96*a*. Springs 100*a* (FIGS. 6 and 7) act between the body 96*a* and the swing arms 98*a* for normally urging the swing arms 98*a* to move the lower ends thereof away from each other. Rollers 102*a* are rotatably supported respectively on the lower ends of the swing arms 98*a*.

Figure 6:
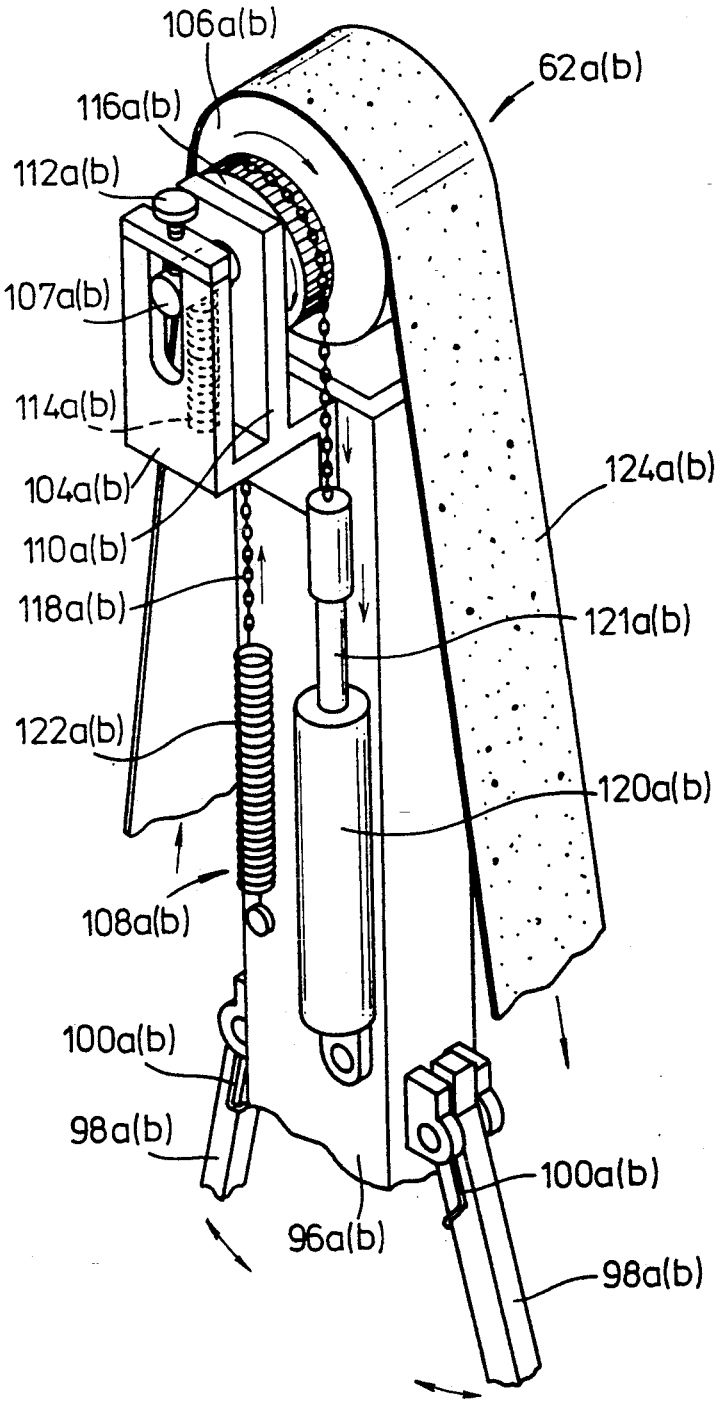
FIG. 6 is a fragmentary perspective view of a feed means of the sanding apparatus of the invention.

A driver roller 106a is supported on the upper end of the body 96a by means of a bracket 104a. The driver roller 106a is rotatable stepwise about its own axis in angular increments in one direction by means of a feed means 108a. More specifically, as shown in FIG. 6, a rotatable shaft 107a extending axially centrally from the driver roller 106a is fitted in and supported on a support pate 110a of the bracket 104a. An adjustment screw 112a mounted on the bracket 104a above the shaft 107a has a lower end engaging the distal end of the shaft 107a, and a coil spring 114a supported in the bracket 104a below the shaft 107a has an upper end engaging the shaft 107a. The driver roller 106a can therefore angularly be adjusted by turning the adjustment screw 112a in one direction or the other.

A chain wheel 116a is mounted on the shaft 107a between the support plate 110a and the driver roller 106a, the chain wheel 112a having a ratchet mechanism (not shown) for allowing the driver roller 106a to rotate only in one direction. A chain 118a is trained around the chain wheel 116a in driving relation and has one end coupled to a piston rod 121a extending vertically upwardly from an air cylinder 120a fixed to the body 96a. The other end of the chain 118a is connected to the upper end of a tension spring 122a, the other end of which is secured to the body 96a. Around the driver roller 106a and the rollers 102a, there is trained a sanding member such as a sanding belt 124a comprising an endless belt of paper, cloth, or the like with an abrasive grain glued fast. The sanding belt 124 is kept to a predetermined tension under the resiliency of the springs 100a acting on the swing arms 98a on which the rollers 102a are supported. The sanding belt 124 is oriented by the rollers 102a in a direction normal to the direction (indicated by the arrows $X_1$, $X_2$) in which a workpiece W is fed. The workpiece W is shown herein as being a piece of wood furniture such as a wood frame.

Figure 7:
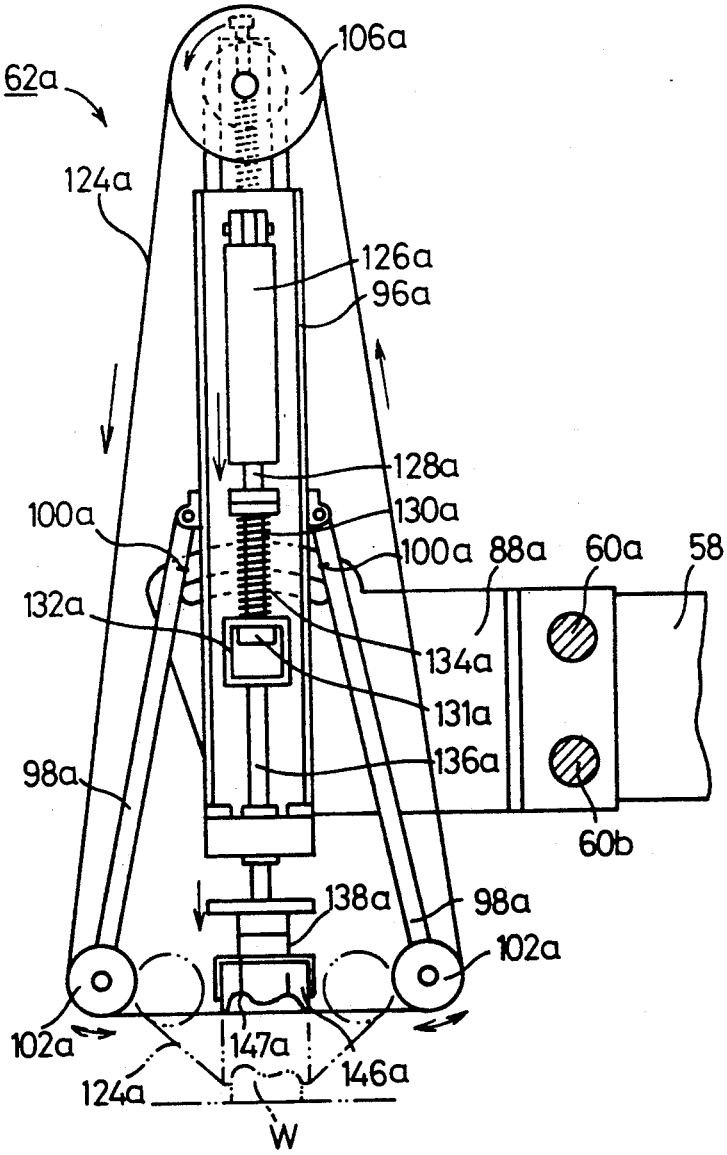
FIG. 7 is a rear elevational view of a sanding mechanism of the sanding apparatus of the invention.
Figure 8:
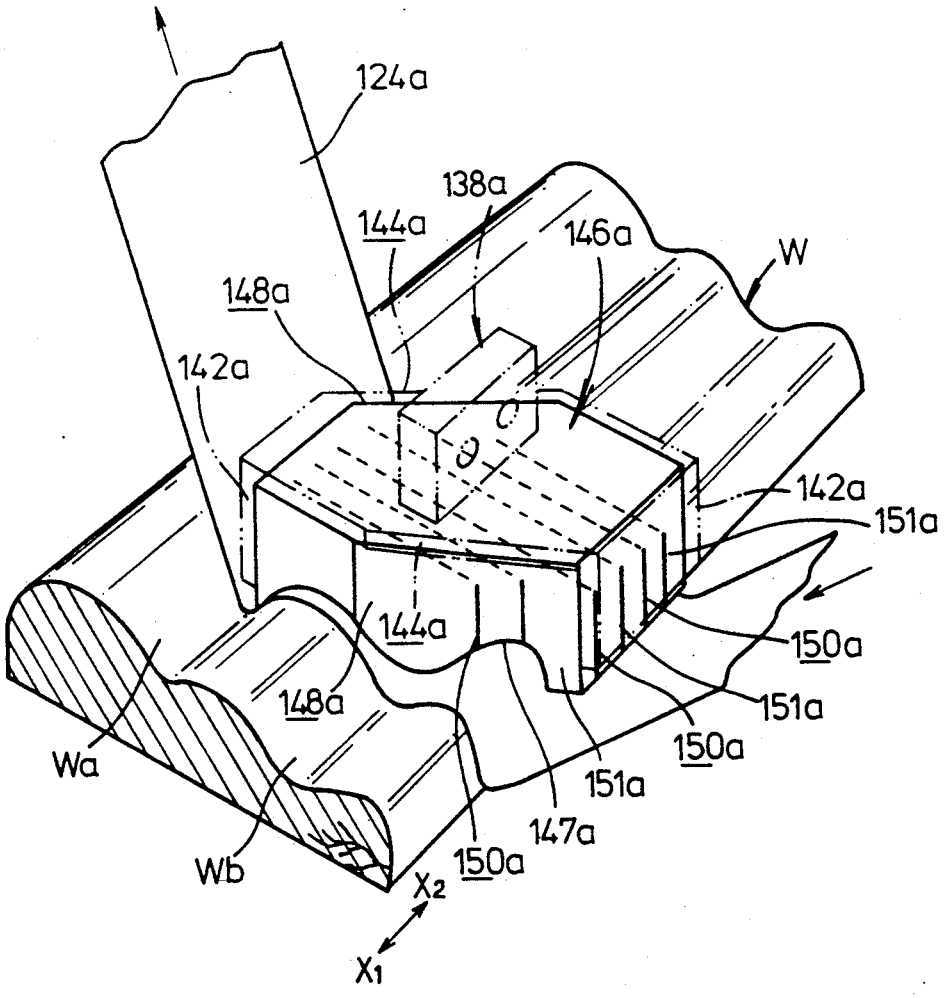
FIG. 8 is an enlarged perspective view of a pad of the sanding apparatus of the invention.

As shown in FIG. 7, a cylinder 126a is vertically disposed securely in the body 96a. The cylinder 126a has a piston rod 128a extending downwardly and connected to one end of a connecting rod 130a. The other end of the connecting rod 130a extends into a hollow casing 132a and has a larger-diameter portion 131a by which the casing 132a is suspended. A coil spring 134a is disposed around the connecting rod 132a and has opposite ends connected to said one end of the connecting rod 130a and the casing 132a. A presser rod 136a extends downwardly from the casing 132a and has a lower end on which an attachment base 138a is detachably mounted by means of a bolt 140a (see FIG. 9). As shown in FIG. 8, the attachment base 138a is substantially channel-shaped in cross section and has downwardly extending guides 142a on its opposite ends and diametrically opposite recesses 144a.

A pad 146a attached to the attachment base 138a is made of an elastomeric material such as synthetic resin or rubber and has recesses 148a positioned at the respective recesses 144a of the attachment base 138a. The pad 146a has a pressing surface 147a of an uneven or irregular configuration complementary to a carved or uneven surface Wa of the workpiece W which is to be sanded. The pressing surface 147a has a plurality of cuts 150a of a predetermined depth which are defined in the pressing surface 147a and extend perpendicularly to the direction of feed of the workpiece W. The pressing surface 147a is therefore divided by the cuts 150a into a plurality of independent pressing regions 151a.

The first sanding mechanism 62a is basically constructed as described above, and the second sanding mechanism 62b is of an identical structure. The pads 146a, 146b are symmetrically shaped, and the recesses 148a, 148b defined in the respective pads 146a, 146b are inclined at the same angle as the angle of mating surfaces of a miter joint at each corner of the workpiece W (see FIG. 10).

As shown in FIGS. 3 and 4, a pair of bent rods 152a, 152b is mounted on the block 52, the bent rods 152a, 152b having horizontal portions with a cover 154 supported on distal ends thereof. The cover 154 supports air jet nozzles 156a, 156b connected through pipes (not shown) to the air cylinders 120a, 120b of the respective feed means 108a, 108b. Air discharged from the air cylinders 120a, 120b is ejected toward the sand belts 124a, 124b to clean the same. A duct 158 is mounted on the cover 154 and connected to a pump (not shown) for drawing floating dust particles which are produced by applying air jets to the sand belts 124a, 124b.

A suction port 159 (FIG. 4) is disposed near the first table 28, for example, for drawing dust particles produced when the workpiece W is sanded by the first and second sanding mechanisms 62a, 62b.

A control box 162 (FIG. 3) is supported on a side of the block 52 by means of a guide bar 160 for horizontal movement in the same direction as that of movement of the auxiliary table 38. The control box 162 includes a hand 164 for controlling operation of the first and second sanding mechanisms 62a, 62b.

The sanding apparatus 20 is basically constructed as described above. Operation and advantages of the sanding apparatus 20 will now be described below.

The auxiliary table 38 is moved so as to be spaced from the first table 28 while being guided by the guide bars 36a, 36b, and then fixed in position dependent on the dimensions of the workpiece W which is to be sanded while being placed on the tables 28, 38. Likewise, the control box 162 is positioned through the guide bar 160 in relation to the auxiliary table 38, so that the hand 164 of the control box 162 can easily be gripped by the operator.

The vertical positions of the first and second sanding mechanisms 62a, 62b are adjusted by the lifting and lowering means 50. More specifically, the handle 54 is rotated in a prescribed direction to rotate the shaft 56 to lift or lower the block 52 through the non-illustrated ball screw for thereby vertically adjusting the position of the first and second sanding mechanisms 62a, 62b. The block 52 is also displaced with respect to the frame 24 by the non-illustrated actuator to position the first and second sanding mechanisms 62a, 62b in the direction across the first table 28.

The angular positions of the driver rollers 106a, 106b are then adjusted such that the sanding belts 124a, 124b will be fed predetermined lengths by the feed means 108a, 108b without being laterally displaced. Such angular adjustments are actually effected by turning the adjustment screws 112a, 112b which are held against the shafts 107a, 107b of the driver rollers 106a, 106b to vary the angular positions of the shafts 107a, 107b which are vertically held by the adjustment screws 112a, 112b and the coil springs 114a, 114b.

The hand 164 of the control box 162 housing a main controller (not shown) is then operated to actuate the first and second sanding mechanisms 62a, 62b.

As shown in FIG. 7, the cylinder 126a of the first sanding mechanism 62a is operated to lower the piston rod 128*a* in the direction of the arrow to lower the connecting rod 130*a*, thus moving down the pad 146*a* with the attachment base 138*a* through the presser rod 136*a*. At this time, since the spring 134*a* acts between the connecting rod 130*a* and the casing 132*a*, the pressing surface 147*a* of the pad 146*a* presses the sanding belt 124*a* against the carved surface Wa of the workpiece W under the resiliency of the spring 134*a*. In the second sanding mechanism 62*b*, similarly, the sanding belt 124*b* is resiliently pressed against the carved surface Wa by the pad 146*b*.

Then, the feed rollers 34*a*, 34*b* are rotated in one direction by the non-illustrated rotative drive source to feed the workpiece W placed on the tables 28, 38 in the direction of the arrow $X_1$, and at the same time the rotative drive source 66 of the displacing means 64 is actuated. As illustrated in FIG. 5, when the first pulley 68 is rotated in the direction of the arrow, for example, by the rotative drive source 66, the second pulley 72 is rotated through the belt 70 to cause the shaft 74 to rotate the first and second intermeshing gears 76, 78 in opposite directions. Therefore, the sliders 88*a*, 88*b* operatively coupled to the first and second gears 76, 78 through the crank means 80*a*, 80*b* are reciprocally displaced along the guide bars 60*a*, 60*b* toward and away from each other.

Figure 10:
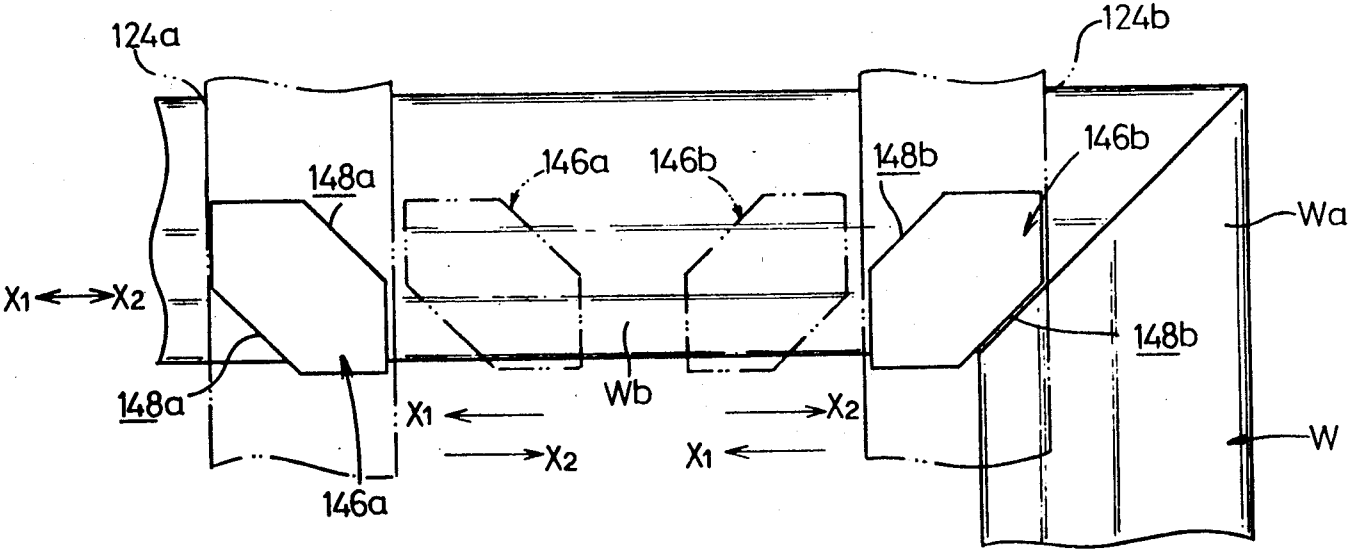
FIG. 10 is a fragmentary view illustrating the manner in which a workpiece is sanded by the sanding apparatus of the invention.

As shown in FIG. 10, the pads 146*a*, 146*b* of the first and second sanding mechanisms 62*a*, 62*b*, while pressing the sanding belts 124*a*, 124*b* against the workpiece W, are simultaneously reciprocally moved toward each other (as indicated by the two-dot-and-dash lines) and away from each other (as indicated by the solid lines). The carved or uneven surface Wa of the workpiece W which is being fed in the direction of the arrow $X_1$ is therefore sanded by the reciprocally moving sanding belts 124*a*, 124*b*. When the pad 146*b* of the second sanding mechanism 62*b* reaches a corner of the workpiece W, the recess 148*b* in the pad 146*b* allows the miter joint corner of the workpiece W to be appropriately sanded by the sanding belt 124*b*.

When the sanding capability of the sanding belt 124*a* which has sanded the workpiece surface Wa is lowered, the sanding belt 124*a* is fed with respect to the pad 146*a* by the feed means 108*a*. More specifically, the cylinder 126*a* is actuated to lift the attachment base 138*a* and the pad 146*a*, and the air cylinder 120*a* of the feed means 108*a* is operated to displace the piston rod 121*a* downwardly in the direction of the arrow in FIG. 6. The chain 118*a* connected at one end to the piston rod 121*a* is displaced in the directions of the arrows against the tension of the spring 122*a*, thus rotating the chain wheel 116*a* through a predetermined angle in the direction of the arrow. The shaft 107*a* is also rotated to rotate the driver roller 106*a* for feeding the sanding belt 124*a* trained around the rollers 106*a*, 102*a* by a predetermined length until a new abrasive surface of the sanding belt 124*a* is brought into a position underneath the pad 146*a*.

Then, the air cylinder 120*a* is inactivated to permit the piston rod 121*a* to be extended in the direction opposite to the direction of the arrow under the tension of the spring 122*a* applied through the chain 118*a*. Therefore, the chain wheel 116*a* is rotated in the opposite direction, but the shaft 107*a* which engages the chain wheel 116*a* through the non-illustrated ratchet mechanism is not rotated in the opposite direction.

When the air cylinder 120*a* is operated to feed the sanding belt 124*a* a prescribed length, as described above, air discharged from the air cylinder 120*a* is supplied under pressure through the non-illustrated pipe to the nozzle 156*a* mounted on the cover 154. The air is then ejected under pressure from the nozzle 156*a* toward the sanding belt 124*a* to remove sanded dust particles off the sanding belt 124*a*, whereupon the removed dust particles are drawn out through the duct 158 by the action of the non-illustrated pump connected to the duct 158. By applying air under pressure to the sanding belt 124*a* to clean the same, the sanding belt 124*a* is prevented from being loaded, and can continuously sand the workpiece W effectively.

As the sanding belt 124*a* is fed successive lengths by the feed means 108*a*, the entire sanding belt 124*a* is eventually circulated in sanding operation, and thereafter exactly the same sanding areas on the sanding belt 124*a* as those which were previously put to use may reach the pad 146*a*. To change such sanding areas on the sanding belt 124*a*, the sanding belt 124*a* may be manually fed a different length by the operator without actuating the feed means 108*a* so that different sanding areas from those previously used will reach the pad 146*a*. Should sanding areas on the sanding belt 124*a* be automatically changed, a detector such as an encoder is associated with the driver roller 106*a*, and when one revolution of the sanding belt 124*a* is detected by the detector, the stroke of the air cylinder 120*a* is varied. Thus, different sanding areas from the previous sanding areas can subsequently automatically be brought to the pad 146*a*. The stroke of the air cylinder 122*a* can easily be varied by employing a signal from any of various displacement sensors such as a proximity switch, a magnetic sensor, and the like which is combined with the air cylinder 122*a*.

The carved or uneven surface Wa of the workpiece W is sanded in the manner described above. The workpiece surface Wa may additionally be sanded in the following manner: After the workpiece W has been fed in the direction of the arrow $X_1$, the feed rollers 34*a*, 34*b* are rotated in the direction opposite to the previous direction to displace the workpiece W in the direction of the arrow $X_2$, while at the same time the workpiece W is sanded by the first and second sanding mechanisms 62*a*, 62*b*. The surface Wa of the workpiece W can also be sanded by the first and second sanding mechanisms 62*a*, 62*b* while the workpiece W is being reciprocally moved a desired number of times in the directions of the arrows $X_1$, $X_2$.

The second table 46 is used when sanding an edge surface of the workpiece W. More specifically, the workpiece W is placed edgeways on the second table 46 so that a lower edge surface of the workpiece W is held against the feed rollers 48*a*, 48*b*. Then, the feed rollers 48*a*, 48*b* are rotated to feed the workpiece W in the direction of the arrow $X_1$ or $X_2$, while at the same time the upper edge surface of the workpiece W is sanded by the first and second sanding mechanisms 62*a*, 62*b*. The height of the workpiece W placed on the second table 46 can be adjusted by turning the handle 44 in one direction or the other to rotate the first screw shaft 40 and hence the second screw shafts 42*a*, 42*b*, thus lowering or lifting the second table 46.

In this embodiment, the sanding belts 124*a*, 124*b* are oriented perpendicularly to the directions of feed of the workpiece W (as indicated by the arrows $X_1$, $X_2$), and pressed against the workpiece surface Wa by the respective pads 146*a*, 146*b* to sand the workpiece surface Wa. Unlike the apparatus in which a sanding belt is oriented in the same direction as the direction of feed of a workpiece, the sanding belts 124a, 124b do not have any portions which are not used in sanding the workpiece W. More specifically, as shown in FIGS. 8 and 10, the entire abrasive surfaces of the sanding belts 124a, 124b can economically be employed to sand the workpiece W. Moreover, since the sanding belts 124a, 124b are intermittently fed successive lengths by the feed means 108a, 108b, it is easily possible to bring new sanding areas on the sanding belts 124a, 124b into cooperation with the pads 146a, 146b for sanding the workpiece W. Accordingly, the carved or irregular surface Wa of the workpiece W can successively and highly accurately be sanded.

As described above, the sanding belts 124a, 124b of the workpiece W (as indicated by the arrows $X_1$, $X_2$). Therefore, two or more sanding belts of different abrasive grains, for example, may be combined with the pads 146a, 146b for sanding the workpiece W. Consequently, different sanding operations employing different types of sanding belts, which have heretofore been effected individually, can be performed highly efficiently in one sanding process.

The rollers 102a supporting the sanding belt 124a are supported on the lower ends of the swing arms 98a, respectively, the other ends of which are resiliently supported on the body 96a by the respective springs 100a. When the pad 146a is displaced toward the workpiece W by actuating the cylinder 126a, the swing arms 98a supporting the respective rollers 102a are angularly displaced toward each other (as indicated by the two-dot-and-dash lines in FIG. 7) by the pad 146a pressing the sanding belt 124a. The sanding belt 124a which is pressed against the surface Wa of the workpiece W by the pad 146a is not subjected to excessive tension. The tension of the sanding belt 124a is considerably smaller than if the sanding belt were continuously fed in sanding the workpiece. Even if the workpiece surface Wa to be sanded has a complex shape, therefore, the sanding belt 124a can be held reliably in abrasive contact with the workpiece surface Wa. As a result, it is possible for the sand belt 124a to uniformly sanding the entire carved or uneven workpiece surface Wa. Where the workpiece surface Wa is painted, the paint film will not be removed by the sanding belt 124a, and the painted surface can well be sanded without damage.

Figure 9:
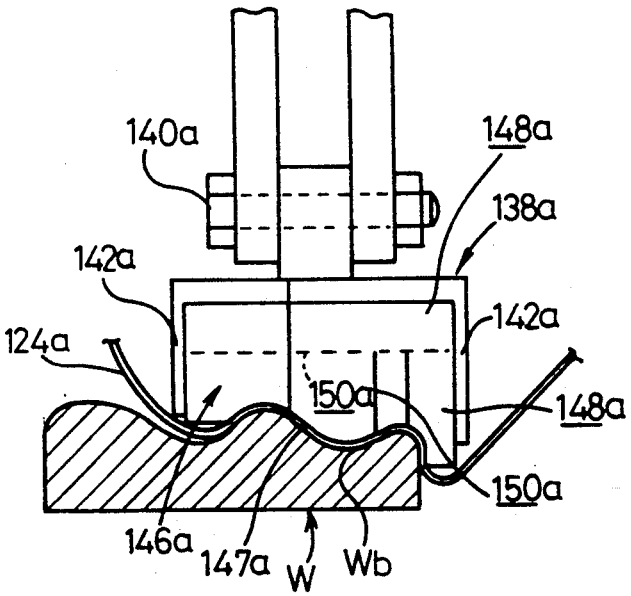
FIG. 9 is a front elevational view, partly in cross section, showing the pad of FIG. 8.

In the illustrated embodiment, the first and second sanding mechanisms 62a, 62b are provided, and the pads 146a, 146b thereof are displaceable toward and away from each other by the displacing means 64 Since the workpiece W can be sanded by simultaneously displacing the pads 146a, 146b, in respective different directions, pulling and pushing forces caused by the pads 146a, 146b are cancelled out. By way of example, if only one such pad were to be moved in a direction back and forth along the feed direction of the workpiece, the workpiece would necessarily be pulled and pushed by the pad, resulting in unwanted present invention, two pads 146a and 146b are always moved back and forth across the workpiece in respective mutually different directions. Therefore, any pulling force applied to the workpiece by one of the pads is simultaneously cancelled out by a pushing force exerted by the other pad and vice versa. Therefore, all such forces are equalized while reducing vibrations applied to the workpiece, and the workpiece can be smoothly fed through the sanding apparatus 20 in the direction of arrows $x_1$ and $x_2$, while also preventing the apparatus from being vibrated and producing noise. Furthermore, since the load required to move the workpiece is clearly less in the absence of such pulling and pushing forces, the workpiece can be advanced through the sanding apparatus using just two rollers 34a and 34b located on the underside of the workpiece. Therefore, it is easy for the sanding belts to be applied to inner areas of the workpiece highly accurately. As shown in FIGS. 8 and 9, the sanding belt can effectively reach even inside contoured surfaces $W_a$ of the workpiece to efficiently and evenly sand all contoured surfaces $W_a$ and $W_b$ of the workpiece.

Figure 11:
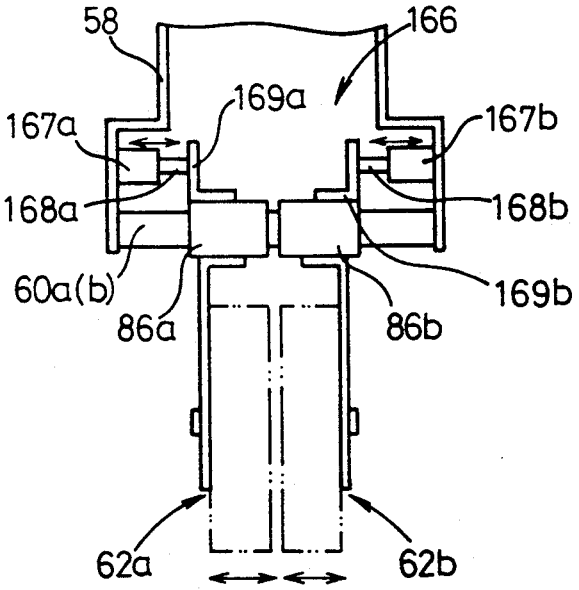
FIG. 11 is a plan view of a displacing means according to another embodiment of the present invention.

As described above, the displacing means 64 for reciprocally displacing the first and second sanding mechanisms 62a, 62b comprises the crank means 80a, 80b for converting the rotation of the rotative drive source 66 into linear displacements of the sliders 86a, 86b. FIG. 11 shows a displacing mean 166 according to another embodiment of the present invention. The displacing means 166 comprises a pair of linear actuators 167a, 167b such as cylinders, solenoid-operated valves, or the like mounted on the guide frame 58, the linear actuators 167a, 167b having respective rods 168a, 168b connected respectively to the sliders 86a, 86b through attachment plates 169a, 169b. When the linear actuators 167a, 167b are simultaneously operated, the rods 168a, 168b are displaced toward and away from each other to reciprocally move the sliders 86a, 86b toward and away from each other. Any of various known mechanisms other than the displacing means 64 or 166 may be employed insofar as it can displace the sliders 86a, 86b in mutually different directions.

The first and second sanding mechanisms 62a, 62b are tiltable independently of each other. More specifically, in the first sanding mechanism 62a, the bracket 88a is fixed to the slider 86a, and the body 96a is mounted on the bracket 88 by the knobs 94a, 95a extending through the hole 90a and the arcuate groove 92a which are defined in the bracket 88a. After the knob 95a has been loosened, the body 96a is brought into a desired angular position with respect to the bracket 88a within the angular range defined by the guide groove 92a, and then the knob 95a is tightened to hold the pad 146a in the desired angular position. This angular adjusting capability allows the pressing surface 147a of the pad 146a to be held reliably and intimately against the irregular surface Wa of the workpiece W even when the surface Wa includes a steep surface. The second sanding mechanism 62b may be kept in the position shown in FIG. 3, whereas the first sanding mechanism 62a may be tilted to a certain angular position, for wholly sanding the entire desired surface of the workpiece W highly efficiently.

Furthermore, the pad 146a has the plural cuts 150a of a certain depth extending in a direction normal to the direction of feed of the workpiece W, dividing the pressing surface 147a into the substantially independent pressing regions 151a. Even if different workpieces W have different carved or uneven surfaces Wa due to the level of machining accuracy of the machine which produced the workpieces W, it is not necessary to exert a considerably large pressure on the pad 146a in order to bring the entire pressing surface 147a of the pad 146a into intimate contact with the workpiece surfaces Wa. More specifically, because the pressing regions 151a of the pad 146a are independently deformable in complementary relation to the configuration of the workpiece surface Wa, the entire pressing surface 147a can be reliably held intimately against the irregular workpiece surface Wa simply by applying a relatively small pressure to the pad 146*a*. Consequently, any undesirably large pressure is not and the drive source for feeding the workpiece W in the directions of the arrows $X_1$, $X_2$ with the feed rollers 34*a*, 34*b* may be of a reduced capacity and size. In addition, the workpiece W can be fed smoothly and sanded highly accurately. The attachment base 138*a* which holds the pad 146*a* has the guides 142*a* projecting downwardly from the opposite ends in a direction normal to the direction in which the workpiece W is sanded. When the pad 146*a* is pressed down against the workpiece W, the guides 142*a* prevent the pad 146*a* from being spread outwardly but retain the pressing surface 147*a* in reliable contact with the workpiece surface Wa.

Figure 12:
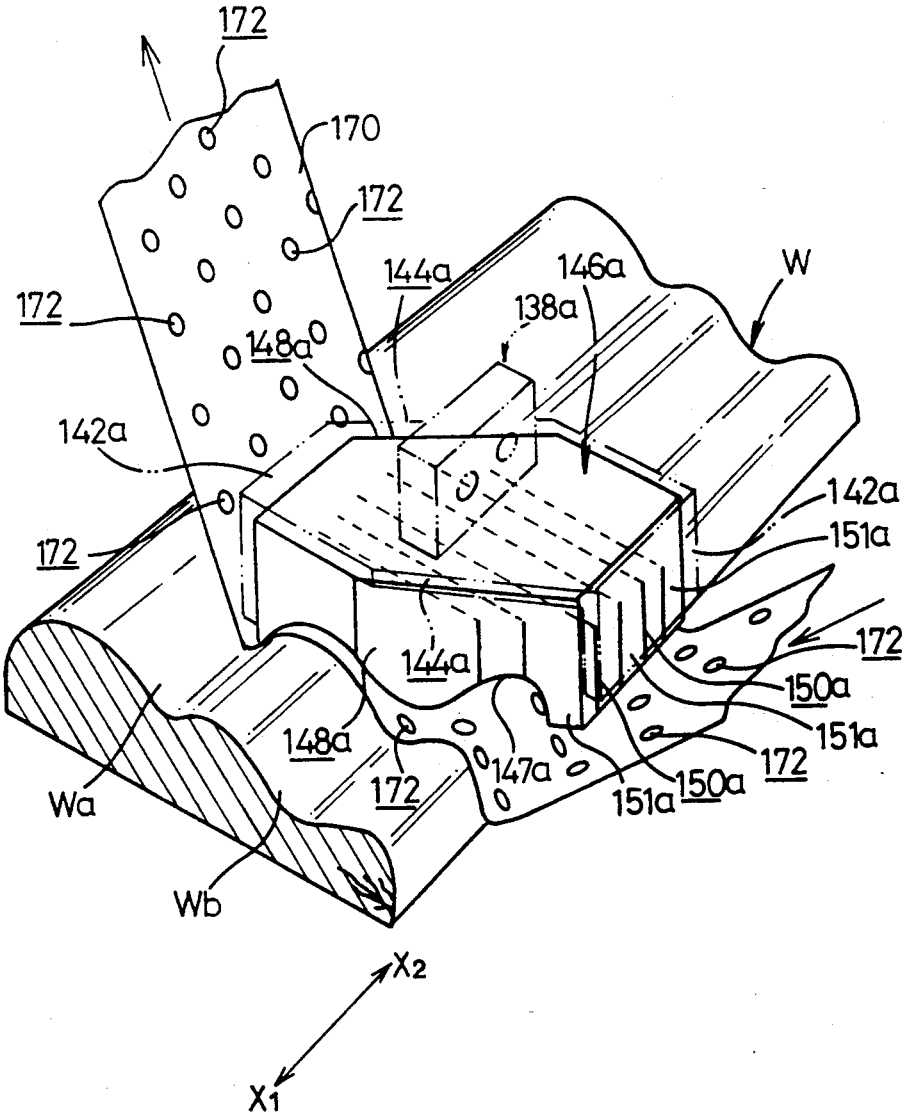
FIG. 12 is a perspective view of a sanding belt according to still another embodiment of the present invention.

Each of the sanding belts 124*a*, 124*b* may be replaced with a sand belt 170, shown in FIG. 12, according to still another embodiment of the present invention. The sanding belt 170 has a plurality of small holes 172 defined therein which are positioned so as not to lie closely in the sanding direction, i.e., in the longitudinal direction of the sanding belt 172, and also are distributed substantially uniformly transversely across the sanding belt 170. The sanding belt 170 may be made of paper, cloth, or a mesh belt material with abrasive grain glued to one surface thereof Where the sanding belt 170 is made of a mesh belt material, the sanding belt itself performs the same function as that of the small holes 172 as described below. Those parts shown in FIG. 12 which are identical to those of FIG. 8 are denoted by identical reference characters and will not be described in detail.

When the workpiece W is sanded by the sanding belt 170 having the holes 172, abrasive grain particles and sanded wood particles which are produced during the sanding operation are gathered into the holes 172, thus preventing the sanding belt 170 from being loaded soon and keeping the sanding capability at a desired level for a longer period of time. The spaces in the holes 172 are also effective in preventing the sanding belt 170 and the workpiece surface Wa from being overheated, and also preventing the workpiece W from being thermally deformed or the workpiece surface Wa from being burned or the paint film on the surface Wa from being thermally modified or degraded.

With the present invention, as described above, for sanding the workpiece with the sanding member or sanding belts, the sanding belts are oriented transversely to the direction in which the workpiece is fed. Therefore, the sanding belts do not leave any portions thereof unused and are highly economical unlike conventional sanding belts which run in the direction of feed of a workpiece while sanding the workpiece. The sanding belts can reliably be held in close abrasive contact with the workpiece surface, and can sand the entire workpiece surface uniformly and smoothly even if the workpiece surface is complex.

The workpiece is sanded while feeding the sanding belts intermittently by certain successive lengths. New sanding areas on the sanding belts can quickly and readily be put to use as desired, so that the sanding belts can maintain high sanding performance and effect efficient sanding operation.

Furthermore, the two pads are reciprocally movable in mutually different directions normal to the direction of feed of the workpiece, and the workpiece is sanded by the sanding members pressed thereagainst by the respective pads. Vibrations produced when the pads are moved are thus canceled out by the opposite reciprocating movements of the pads, preventing the workpiece and the apparatus from being vibrated or producing noise. The workpiece as it is fed is not subjected to unnecessarily large resistive forces, and the drive source for feeding the workpiece may be of a small capacity and size. Inasmuch as the pads themselves are moved, no high tension is applied to the sanding members or sanding belts. Consequently, even curved or irregular workpiece surfaces can uniformly be sanded. The sanding apparatus of the invention is particularly suitable for sanding painted surfaces. By moving the pads back and forth at a relatively high speed along the direction of feed of the workpiece, the workpiece can be sanded with higher accuracy.

Furthermore, any pulling or pushing forces exerted on the workpiece are cancelled out by the mutual and reciprocal movement of the sanding pads. Therefore, the workpiece can be smoothly advanced through the apparatus using only two rollers located on the underside of the workpiece. Thus the sanding belt can easily reach even inside surface contours of the workpiece to effectively and evenly sand all surfaces in a curved workpiece.

In addition, each of the pads for pressing the sanding member against the workpiece surface has a plurality of cuts or slits which divide the pad into a plurality of pressing regions. Even if the surfaces of different workpieces have different shapes, the pressing regions of the pad can individually be deformed, and hence the sanding member can reliably be held in intimate contact with the workpiece surface under reduced pressing forces applied to the pad. The sanding member can well be fitted against the workpiece surface without increasing the pressure applied by the pad to the workpiece. Furthermore, the heat generated by the sanding member and the workpiece when the workpiece is sanded by the sanding member can also be reduced. The reduced pressure applied to sanding member allows the sanding member, e.g., the sanding belt, to be used economically for a prolonged period of time.

A sanding belt according to another embodiment has a plurality of small holes defined therein. The small holes defined in the sanding belt prevent the sanding belt from being loaded soon and also permits generated heat to be radiated. The abrasive surface of the sanding belt and the workpiece surface being sanded are less thermally affected or modified. The sanding belt is therefore rendered more durable, and the workpiece can be sanded highly accurately.

Although certain preferred embodiments have been shown and described, it should be understood that many changes and modifications may be made therein without departing from the scope of the appended claims.

What is claimed is:

1. A method of sanding a surface of a workpiece, comprising the steps of:

feeding said workpiece in a feeding direction;

providing a plurality of endless belt sanding members in juxtaposed relation substantially along said feeding direction such that said endless belt sanding members are oriented in a direction transverse to said feeding direction;

pressing said endless belt sanding members against the surface of the workpiece; and reciprocally moving said endless belt sanding members simultaneously in mutually different directions along said feeding direction.

2. The method according to claim 1, comprising the step of:

intermittently feeding said endless belt sanding members by successive lengths in a direction transverse to said mutually different directions to sand said surface of the workpiece with successively new sanding areas of the endless belt sanding member.

3. An apparatus for sanding a surface of a workpiece comprising:

table means for feeding said workpiece thereon in at least one direction; and a sanding mechanism for pressing a sanding member against the surface of said workpiece to sand said surface, said sanding member comprising an endless belt sanding member oriented in a direction transverse to said one direction, wherein said sanding mechanism includes a body and feed means mounted on said body for intermittently feeding said endless belt sanding member by successive lengths toward said surface of the workpiece with successively new sanding areas of the endless belt sanding member.

4. The apparatus according to claim 3, wherein said feed means comprises a driver roller around which said sanding belt is trained, ratchet means associated with said driver roller, and an actuator for rotating said driver roller in angular increments in one direction through said ratchet means.

5. The apparatus according to claim 4, wherein said actuator comprises a cylinder having a piston rod, said feed means further comprising a chain having one end connected to said piston rod, a chain wheel associated with said ratchet means with said chain trained around said chain wheel, a spring connected to the other end of said chain, whereby said cylinder is actuated to pull said chain longitudinally to cause said chain wheel to rotate said driver roller in a first direction, and said cylinder is inactivated to allow said chain wheel to rotate in a second direction opposite to said first direction under the bias of said spring.

6. The apparatus according to claim 5, wherein said cylinder comprises an air cylinder, further including a nozzle connected to said air cylinder for ejecting air discharged from said air cylinder against said sanding belt to clean the sanding belt.

7. The apparatus according to claim 4, wherein said feed means further comprises an adjustment screw and a resilient member which engage opposite sides of a rotatable shaft extending axially from said driver roller, whereby said driver roller can be tilted by turning said adjustment screw.

8. The apparatus according to claim 3, further including a block which is movable at least vertically, and a bracket mounted on said block, said body being tiltably supported on said bracket.

9. The apparatus according to claim 4, wherein said sanding mechanism further includes at least one swing arm having one end attached to said body and resiliently biased by a resilient member, and a roller supported on the other end of said swing arm, said sanding belt being also trained around said roller.

10. The apparatus according to claim 9, wherein said sanding mechanism includes a pair of swing arms having ends attached respectively to opposite sides of said body, a pair of rollers supported on the other ends of said swing arms, respectively, said sanding belt being also trained around said rollers, and a pad movably mounted on said body between said rollers, the arrangement being such that said sanding belt can be pressed against the surface of said workpiece by displacing said pad toward said workpiece.

11. The apparatus according to claim 10, wherein said sanding mechanism also includes a cylinder and a resilient member for causing said pad to resiliently press said sanding belt against said surface of the workpiece.

12. The apparatus according to claim 3, wherein said table means comprises a first table extending in said one direction, and an auxiliary table disposed alongside of said first table and positionally adjustable in a direction normal to said one direction.

13. The apparatus according to claim 12, wherein said table means further comprises a second table vertically movably disposed below said first table.

14. The apparatus according to claim 3, further comprising a control box for controlling operation of said sanding mechanism, said control box being positionally adjustable in a direction normal to said one direction.

15. The apparatus according to claim 3, further including a suction port for drawing sanded particles, said suction port being disposed near a region where said surface of the workpiece and said sanding member engage each other.

16. An apparatus for sanding a surface of a workpiece comprising:

table means for feeding said workpiece thereon in at least one direction; and a pair of sanding mechanisms for pressing respective endless belt sanding members against the surface of said workpiece to sand said surface, said endless belt sanding members being oriented in a direction transverse to said one direction, said sanding mechanisms including respective pads for pressing said sanding members against the surface of said workpiece, said sanding mechanisms being reciprocally movable in mutually different directions along said one direction.

17. An apparatus according to claim 16, wherein each of said pads has a pressing surface complementary in shape to the shape of said surface of the workpiece, each of said sanding mechanisms includes a cylinder and a resilient member for causing said pad to resiliently press said web-like sanding member against said surface of the workpiece.

18. The apparatus according to claim 16, further including a block which is movable at least vertically, said first and second sanding mechanisms being movably mounted on said block, and displacing means for reciprocally moving said first and second sanding mechanisms toward and away from each other.

19. The apparatus according to claim 18, wherein said displacing means comprises a rotative drive source, and a pair of crank means operatively coupled to said rotative drive source, said crank means being operatively connected to said first and second sanding mechanisms, whereby said first and second sanding mechanisms can be moved toward and away from each other by said rotative drive source through said respective crank means.

20. The apparatus according to claim 18, wherein said displacing means comprises a pair of linear actuators for displacing said first and second sanding mechanisms, respectively, toward and away from each other.

21. The apparatus according to claim 18, further including guide means mounted on said block, said first and second sanding mechanisms including respective sliders mounted on said guide means, brackets coupled to said sliders, respectively, and bodies tiltably supported on said brackets, respectively.

22. The apparatus according to claim 21, wherein each of said sanding mechanisms further includes at least one swing arm having one end attached to said body and resiliently biased by a resilient member, and a roller supported on the other end of said swing arm, wherein each of said endless belt sanding members is trained around said roller.

23. The apparatus according to claim 22, wherein each of said sanding mechanisms includes a pair of swing arms having ends attached respectively to opposite sides of said body, and a pair of rollers supported on the other ends of said swing arms, respectively, said sanding belt being also trained around said rollers, each of said pads being movably mounted on said body between said rollers, the arrangement being such that said sanding belt can be pressed against the surface of said workpiece by displacing said pad toward said workpiece.

24. The apparatus according to claim 16, wherein said table means comprises a first table extending in said one direction, and an auxiliary table disposed alongside of said first table and positionally adjustable in a direction normal to said one direction.

25. The apparatus according to claim 24, wherein said table means further comprises a second table vertically movably disposed below said first table.

26. The apparatus according to claim 16, further comprising a control box for controlling operation of said sanding mechanisms, said control box being positionally adjustable in a direction normal to said one direction.

27. The apparatus according to claim 16, further including a suction port for drawing sanded particles, said suction port being disposed near a region where said surface of the workpiece and said sanding members engage each other.

28. An apparatus for sanding a surface of a workpiece, comprising:

table means for feeding said workpiece thereon in at least one direction; and a sanding mechanism for pressing an endless belt sanding member against the surface of said workpiece to sand said surface, said endless belt sanding member being oriented in a direction transverse to said one direction, said sanding mechanism including a pad for pressing said sanding member against the surface of said workpiece, said pad having a pressing surface complementary in shape to said surface of said workpiece, said pad having a pressing surface complementary in shape to said surface of the workpiece and having at least one cut cut a predetermined depth into said pressing surface, said cut extending transversely to said one direction and dividing said pad into a plurality of pressing regions.

29. The apparatus according to claim 28, wherein said pad has a plurality of cuts defined in said pressing surface and extending transversely to said one direction.

30. The apparatus according to claim 28 or 29, wherein said pad has a recess defined in a corner thereof and complementary in shape to a surface at a corner of said workpiece.

31. The apparatus according to claim 28, wherein said sanding mechanism has an actuator and an attachment base movable by said actuator, said pad being attached to said attachment base, said attachment base having a pair of guides projecting downwardly from opposite sides thereof across said one direction, said pad being held between said guides.

32. An apparatus for sanding a surface of a workpiece, comprising:

table means for feeding said workpiece thereon in at least one direction; and a sanding mechanism for pressing a sanding member against the surface of said workpiece to sand said surface, said sanding member comprising an endless belt sanding member oriented in a direction transverse to said one direction, said sanding member having spaces therein for preventing the sanding member from being loaded and for radiating frictional heat produced when the surface of the workpiece is sanded by said sanding member.

33. The apparatus according to claim 32, wherein said sanding member has a plurality of holes defined therein as said spaces.

34. The apparatus according to claim 32, wherein said sanding member is of a mesh structure having said spaces.

35. The apparatus according to any of claims 32 through 34, wherein said web-like sanding member comprises an endless sanding belt.

* * * * *